US012250974B2

(12) United States Patent
Lee

(10) Patent No.: US 12,250,974 B2
(45) Date of Patent: Mar. 18, 2025

(54) METHOD FOR CONTROLLING ELECTRIC POWER OF HEATER OF AEROSOL-GENERATING APPARATUS WITH SIGNAL OF CERTAIN FREQUENCY OR LESS AND AEROSOL-GENERATING APPARATUS USING SAME

(71) Applicant: KT&G CORPORATION, Daejeon (KR)

(72) Inventor: Jae Min Lee, Siheung-si (KR)

(73) Assignee: KT&G CORPORATION, Daejeon (KR)

( * ) Notice: Subject to any disclaimer, the term of this patent is extended or adjusted under 35 U.S.C. 154(b) by 1010 days.

(21) Appl. No.: 17/057,245

(22) PCT Filed: Oct. 23, 2019

(86) PCT No.: PCT/KR2019/013998
§ 371 (c)(1),
(2) Date: Nov. 20, 2020

(87) PCT Pub. No.: WO2020/105874
PCT Pub. Date: May 28, 2020

(65) Prior Publication Data

US 2021/0137169 A1 May 13, 2021

(30) Foreign Application Priority Data

Nov. 19, 2018 (KR) ..... 10-2018-0142655

(51) Int. Cl.
*A24F 40/57* (2020.01)

(52) U.S. Cl.
CPC ..... *A24F 40/57* (2020.01)

(58) Field of Classification Search
CPC ..... A24F 40/57
(Continued)

(56) References Cited

U.S. PATENT DOCUMENTS 6,040,560 A * 3/2000 Fleischhauer ..... A24F 40/53 219/494
8,833,364 B2 * 9/2014 Buchberger ..... A24F 40/44 128/200.14
(Continued)

FOREIGN PATENT DOCUMENTS

CA 3028788 A1 11/2018
CN 1498663 A 5/2004
(Continued)

OTHER PUBLICATIONS

Japanese Office Action dated Jan. 17, 2023 in Japanese application No. 2020-543934.
(Continued)

*Primary Examiner* — Harshad C Patel
(74) *Attorney, Agent, or Firm* — Sughrue Mion, PLLC

(57) ABSTRACT

According to an embodiment of the present disclosure, an aerosol generating apparatus includes a heater for generating an aerosol by heating an aerosol generating material; and a controller for controlling electric power supplied to the heater. The controller controls a frequency of an electric power signal to be changed over time within a certain range when the frequency of the electric power signal supplied to the heater is lower than or equal to a preset frequency.

11 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 9,498,000 | B2 * | 11/2016 | Kuczaj | H05B 3/0014 |
| 9,532,600 | B2 * | 1/2017 | Thorens | A24F 40/50 |
| 9,668,521 | B2 * | 6/2017 | Kuczaj | A24F 40/57 |
| 9,713,345 | B2 * | 7/2017 | Farine | A24F 40/57 |
| 9,872,521 | B2 * | 1/2018 | Farine | A24F 40/53 |
| 9,949,507 | B2 * | 4/2018 | Flick | A24F 40/50 |
| 10,051,890 | B2 * | 8/2018 | Mironov | A24F 40/465 |
| 10,624,393 | B2 * | 4/2020 | Kuczaj | H05B 3/0014 |
| 10,674,770 | B2 | 6/2020 | Talon | |
| 11,583,607 | B2 * | 2/2023 | Mofid | A61L 15/425 |
| 2005/0098173 | A1 | 5/2005 | Childers et al. | |
| 2009/0272379 | A1 * | 11/2009 | Thorens | H05B 3/00 219/535 |
| 2015/0245660 | A1 | 9/2015 | Lord | |
| 2016/0331038 | A1 | 11/2016 | Farine et al. | |
| 2016/0374397 | A1 | 12/2016 | Jordan et al. | |
| 2017/0049151 | A1 * | 2/2017 | Xue | H05B 1/0244 |
| 2018/0125119 | A1 | 5/2018 | Cadieux et al. | |
| 2020/0305512 | A1 | 10/2020 | Lim et al. | |

FOREIGN PATENT DOCUMENTS

| | | | |
|---|---|---|---|
| CN | 103989253 | A | 8/2014 |
| CN | 203873009 | U | 10/2014 |
| CN | 105027016 | A | 11/2015 |
| CN | 105054311 | A | 11/2015 |
| CN | 105446393 | A | 3/2016 |
| CN | 108720084 | A | 11/2018 |
| EP | 2217034 | A1 | 8/2010 |
| EP | 2 471 392 | B1 | 9/2013 |
| EP | 2 770 859 | B1 | 12/2018 |
| GB | 2543906 | A | 5/2017 |
| JP | 2007-20320 | A | 1/2007 |
| JP | 2017-118018 | A | 6/2017 |
| JP | 2017-192198 | A | 10/2017 |
| KR | 10-2013-0139276 | A | 12/2013 |
| KR | 10-2014-0094513 | A | 7/2014 |
| KR | 10-2015-0102924 | A | 9/2015 |
| KR | 10-1614171 | B1 | 4/2016 |
| KR | 10-1792905 | B1 | 11/2017 |
| KR | 10-2018-0111460 | A | 10/2018 |
| WO | 2014/102091 | A1 | 7/2014 |
| WO | 2018/001910 | A1 | 1/2018 |

OTHER PUBLICATIONS

Extended European Search Report Dated Jan. 24, 2022 in Korean Application No. 19886794.7.
Office Action issued Aug. 17, 2021 in Japanese Application No. 2020-543934.
Korea Intellectual Property Office Notice of Non-Final Rejection for KR 10-2018-0142655 dated Jun. 10, 2020.
International Search Report for PCT/KR2019/013998 dated Jan. 29, 2020 [PCT/ISA/210].
Office Action issued Mar. 31, 2023 in Chinese Application No. 201980034804.4.

* cited by examiner

METHOD FOR CONTROLLING ELECTRIC POWER OF HEATER OF AEROSOL-GENERATING APPARATUS WITH SIGNAL OF CERTAIN FREQUENCY OR LESS AND AEROSOL-GENERATING APPARATUS USING SAME

CROSS REFERENCE TO RELATED APPLICATIONS

This application is a National Stage of International Application No. PCT/KR2019/013998 filed Oct. 23, 2019, claiming priority based on Korean Patent Application No. 10-2018-0142655 filed Nov. 19, 2018.

TECHNICAL FIELD

The present disclosure relates to a method of controlling electric power of a heater of an aerosol generating apparatus with a signal having a certain frequency or less and an aerosol generating apparatus using the method, and more specifically, to a method of controlling electric power supplied to a heater of an aerosol generating apparatus through a signal having a certain frequency or less so that resonance does not occur when electric power is supplied to a heater of an aerosol generating apparatus, and an aerosol generating apparatus using the method.

BACKGROUND ART

Recently, the demand for alternative ways of overcoming the disadvantages of common cigarettes has increased. For example, there is growing demand for a method of generating an aerosol by heating an aerosol generating material in cigarettes, rather than by combusting cigarettes. Accordingly, research into a heating-type cigarette and a heating-type aerosol generator has been actively conducted.

According to a well-known aerosol generating apparatus, it is common to adopt a signal having a frequency exceeding 20 KHz for transmitting electric power, when heating a heater by supplying electric power to the heater of an aerosol generating apparatus. As described above, when electric power is supplied to a heater with an electric power signal according to a frequency of 20 KHz or more, there is an advantage in that a user does not recognize sound even when resonance occurs because it is beyond an audible frequency range, but loss may occur in energy transmission.

DESCRIPTION OF EMBODIMENTS

Technical Problem

The present disclosure provides a method of controlling so that resonance does not occur even when electric power supplied to a heater of an aerosol generating apparatus is controlled at a frequency lower than or equal to a certain frequency, and an aerosol generating apparatus implemented by the method.

Solution to Problem

According to one embodiment of the present disclosure, an aerosol generating apparatus includes a heater for generating an aerosol by heating an aerosol generating material; and a controller for controlling electric power supplied to the heater, and the controller controls a frequency of an electric power signal to be changed over time within a certain range when the frequency of the electric power signal supplied to the heater is lower than or equal to a preset frequency.

According to another embodiment of the present disclosure, a method of controlling electric power supplied to a heater of an aerosol generating apparatus includes electric power frequency determination of determining whether or not a frequency of an electric power signal supplied to the heater is lower than or equal to a preset frequency; and frequency change control of controlling the frequency of the electric power signal to be changed over time within a certain range when the frequency of the electric power signal is lower than or equal to the preset frequency.

One embodiment of the present disclosure may provide a computer-readable recording medium having stored thereon a program for executing the method.

Advantageous Effects of Disclosure

According to the present disclosure, even if an electric power signal according to a frequency lower than or equal to a specific frequency is used when electric power is supplied to a heater of an aerosol generating apparatus, a resonance sound recognizable by a user is not generated and an electric power loss rate may be minimized.

BEST MODE

Figure 1:
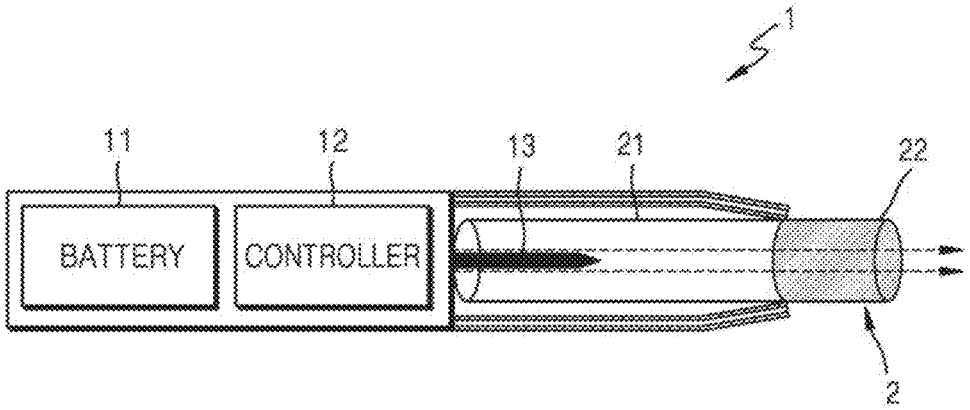
FIGS. 1 to 3 are diagrams showing examples in which a cigarette is inserted into an aerosol generating apparatus.

According to one embodiment of the present disclosure, an aerosol generating apparatus includes a heater configured to generate an aerosol by heating an aerosol generating material; and a controller configured to control electric power supplied to the heater such that a frequency of an electric power signal, which is lower than or equal to a preset frequency, to be changed over time within a preset range.

In the device, the electric power signal may be a pulse width modulation signal.

In the device, the preset frequency may be 20 KHz.

In the device, the certain range may be −10% to +10% on the basis of the frequency of the electric power signal.

In the device, the certain range may be −5% to +5% on the basis of the frequency of the electric power signal.

In the device, the controller may control the frequency of the electric power signal to reach a lowest frequency and a highest frequency periodically according to a fixed cycle.

In the device, the controller may control a unit of time for changing the frequency of the electric power signal to be increased or decreased according to a preset pattern.

According to another embodiment of the present disclosure, a method of controlling electric power supplied to a heater of an aerosol generating apparatus with a signal having a frequency less than or equal to a preset frequency, the method comprising: determining whether or not a frequency of an electric power signal supplied to the heater is lower than or equal to a preset frequency; and controlling the frequency of the electric power signal to be changed over time within a preset range based on the frequency of the electric power signal being lower than or equal to the preset frequency.

In the method, the electric power signal may be a pulse width modulation signal.

In the method, the preset frequency may be 20 KHz.

In the method, the certain range may be −10% to +10% on the basis of the frequency of the electric power signal.

In the method, the certain range may be −5% to +5% on the basis of the frequency of the electric power signal.

In the method, the frequency of the electric power signal may be controlled to reach a lowest frequency and a highest frequency periodically according to a fixed cycle, in the frequency change control.

In the method, a unit of time for changing the frequency of the electric power signal may be controlled to be increased or decreased according to a preset pattern, in the frequency change control.

One embodiment of the present disclosure may provide a computer-readable recording medium having stored thereon a program for executing the method.

MODE OF DISCLOSURE

As the present disclosure allows for various changes and numerous embodiments, particular embodiments will be illustrated in the drawings and described in detail in the written description. The attached drawings for illustrating the present disclosure are referred to in order to gain a sufficient understanding, the merits thereof, and the objectives accomplished by the implementation. However, the present disclosure may have different forms and should not be construed as being limited to the descriptions set forth herein.

Example embodiments will be explained in detail below with reference to the accompanying drawings. Those elements that are the same or are in correspondence are rendered the same reference numeral regardless of the figure number, and redundant explanations are omitted.

While such terms as "first," "second," etc., may be used to describe various elements, such elements must not be limited to the above terms. The above terms are used only to distinguish one element from another.

An expression used in the singular encompasses the expression of the plural, unless it has a clearly different meaning in the context.

In the present specification, it is to be understood that the terms such as "including," "having," and "comprising" are intended to indicate the existence of the features or elements disclosed in the specification, and are not intended to preclude the possibility that one or more other features or elements may exist or may be added.

When a certain embodiment may be implemented differently, a specific process order may be performed differently from the described order. For example, two consecutively described processes may be performed substantially at the same time or performed in an order opposite to the described order.

Hereinafter, embodiments of the present disclosure will be described in detail with reference to the drawings.

Figure 2:
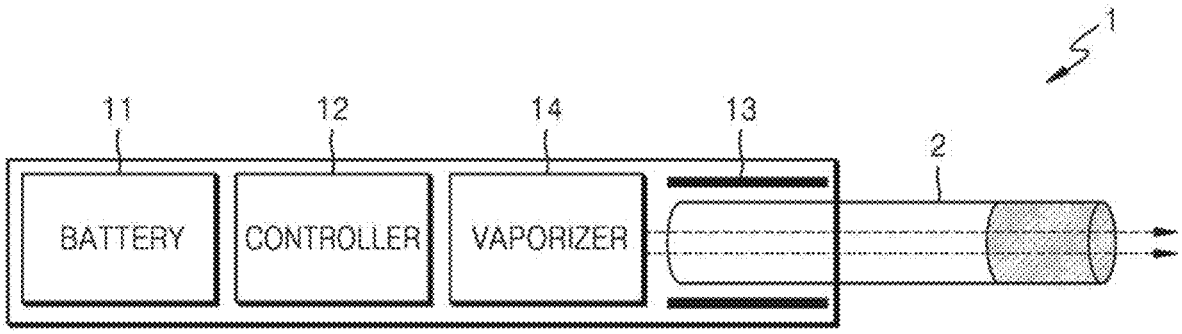
Figure 3:
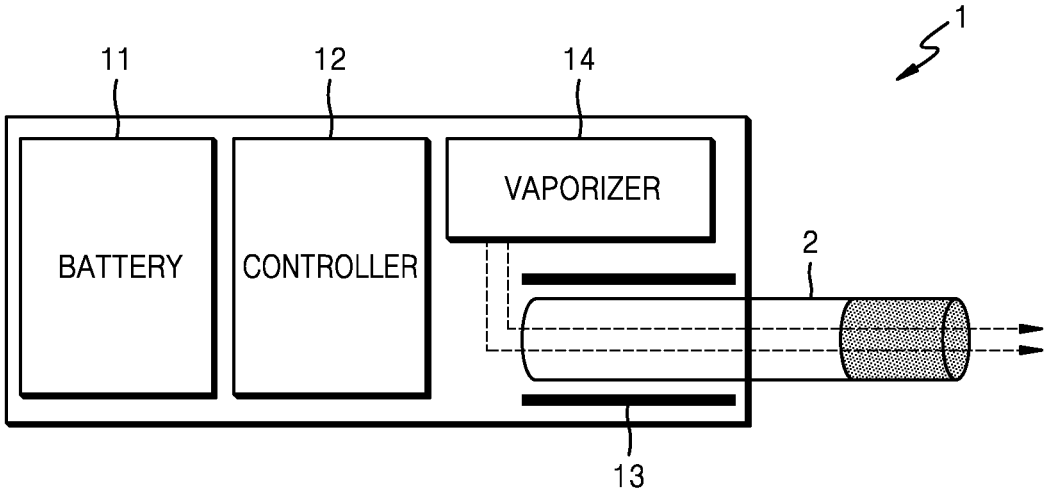

FIGS. 1 through 3 are diagrams showing examples in which a cigarette is inserted into an aerosol generating apparatus.

Referring to FIG. 1, an aerosol generator 1 includes a battery 11, a controller 12, and a heater 13. Referring to FIG. 2 and FIG. 3, the aerosol generator 1 further includes a vaporizer 14. Also, a cigarette 2 may be inserted into an inner space of the aerosol generator 1.

The elements related to the embodiment are illustrated in the aerosol generator 1 of FIGS. 1 to 3. Therefore, one of ordinary skill in the art would appreciate that other universal elements than the elements shown in FIGS. 1 to 3 may be further included in the aerosol generator 1.

Also, FIGS. 2 and 3 show that the aerosol generator 1 includes the heater 13, but if necessary, the heater 13 may be omitted.

In FIG. 1, the battery 11, the controller 12, and the heater 13 are arranged in a row. Also, FIG. 2 shows that the battery 11, the controller 12, the vaporizer 14, and the heater 13 are arranged in a row. Also, FIG. 3 shows that the vaporizer 14 and the heater 13 are arranged in parallel with each other. However, an internal structure of the aerosol generator 1 is not limited to the examples shown in FIGS. 1 to 3. That is, according to a design of the aerosol generator 1, arrangement of the battery 11, the controller 12, the heater 13, and the vaporizer 14 may be changed.

When the cigarette 2 is inserted into the aerosol generator 1, the aerosol generator 1 operates the heater 13 and/or the vaporizer 14 to generate aerosol from the cigarette 2 and/or the vaporizer 14. The aerosol generated by the heater 13 and/or the vaporizer 14 may be transferred to a user via the cigarette 2.

If necessary, even when the cigarette 2 is not inserted in the aerosol generator 1, the aerosol generator 1 may heat the heater 13.

The battery 11 supplies the electric power used to operate the aerosol generator 1. For example, the battery 11 may supply power for heating the heater 13 or the vaporizer 14 and supply power for operating the controller 12. In addition, the battery 11 may supply power for operating a display, a sensor, a motor, and the like installed in the aerosol generator 1.

The controller 12 controls the overall operation of the aerosol generator 1. In detail, the controller 12 may control operations of other elements included in the aerosol generator 1, as well as the battery 11, the heater 13, and the vaporizer 14. Also, the controller 12 may check the status of each component in the aerosol generator 1 to determine whether the aerosol generator 1 is in an operable state.

The controller 12 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the present disclosure may be implemented in other forms of hardware.

The heater 13 may be heated by the electric power supplied from the battery 11. For example, when the cigarette is inserted in the aerosol generator 1, the heater 13 may be located outside the cigarette. Therefore, the heated heater 13 may raise the temperature of an aerosol generating material in the cigarette.

The heater 13 may be an electro-resistive heater. For example, the heater 13 includes an electrically conductive track, and the heater 13 may be heated as a current flows through the electrically conductive track. However, the heater 13 is not limited to the above example, and any type of heater may be used provided that the heater is heated to a desired temperature. Here, the desired temperature may be set in advance on the aerosol generator 1, or may be set by a user.

In addition, in another example, the heater 13 may include an induction heating type heater. In detail, the heater 13 may include an electrically conductive coil for heating the cigarette in an induction heating method, and the cigarette may include a susceptor that may be heated by the induction heating type heater.

For example, the heater 13 may include a tubular type heating element, a plate type heating element, a needle type heating element, or a rod type heating element, and may heat the inside or outside of the cigarette 2 according to the shape of the heating element.

Also, there may be a plurality of heaters 13 in the aerosol generator 1. Here, the plurality of heaters 13 may be arranged to be inserted into the cigarette 2 or on the outside of the cigarette 2. Also, some of the plurality of heaters 13 may be arranged to be inserted into the cigarette 2 and the other may be arranged on the outside of the cigarette 2. In addition, the shape of the heater 13 is not limited to the example shown in FIGS. 1 to 3, but may be manufactured in various shapes.

The vaporizer 14 may generate aerosol by heating a liquid composition and the generated aerosol may be delivered to the user after passing through the cigarette 2. In other words, the aerosol generated by the vaporizer 14 may move along an air flow passage of the aerosol generator 1, and the air flow passage may be configured for the aerosol generated by the vaporizer 14 to be delivered to the user through the cigarette.

For example, the vaporizer 14 may include a liquid storage unit, a liquid delivering unit, and a heating element, but is not limited thereto. For example, the liquid storage unit, the liquid delivering unit, and the heating element may be included in the aerosol generator 1 as independent modules.

The liquid storage may store a liquid composition. For example, the liquid composition may be a liquid including a tobacco containing material including a volatile tobacco flavor component, or a liquid including a non-tobacco material. The liquid storage unit may be attached to/detached from the vaporizer 14 or may be integrally manufactured with the vaporizer 14.

For example, the liquid composition may include water, solvents, ethanol, plant extracts, flavorings, flavoring agents, or vitamin mixtures. The flavoring may include, but is not limited to, menthol, peppermint, spearmint oil, various fruit flavoring ingredients, etc. The flavoring agent may include components that may provide the user with various flavors or tastes. Vitamin mixtures may be a mixture of at least one of vitamin A, vitamin B, vitamin C, and vitamin E, but are not limited thereto. Also, the liquid composition may include an aerosol former such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivering unit. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but is not limited thereto.

In addition, the aerosol generator 1 may further include universal elements, in addition to the battery 11, the controller 12, the heater 13, and the vaporizer 14. For example, the aerosol generator 1 may include a display capable of outputting visual information and/or a motor for outputting tactile information. In addition, the aerosol generator 1 may include at least one sensor (a puff sensor, a temperature sensor, a cigarette insertion sensor, etc.) Also, the aerosol generator 1 may be manufactured to have a structure, in which external air may be introduced or internal air may be discharged even in a state where the cigarette 2 is inserted.

Although not shown in FIGS. 1 to 3, the aerosol generator 1 may configure a system with an additional cradle. For example, the cradle may be used to charge the battery 11 of the aerosol generator 1. Alternatively, the heater 13 may be heated in a state in which the cradle and the aerosol generator 1 are coupled to each other.

The cigarette 2 may be similar to a traditional combustive cigarette. For example, the cigarette 2 may include a first portion containing an aerosol generating material and a second portion including a filter and the like. The second portion of the cigarette 2 may also include the aerosol generating material. For example, an aerosol generating material made in the form of granules or capsules may be inserted into the second portion.

Alternatively, only a portion of the first portion may be inserted into the aerosol generator 1 or the entire first portion and a portion of the second portion may be inserted into the aerosol generator 1. The user may puff aerosol while holding the second portion by the mouth of the user. The user may puff aerosol while holding the second portion by the mouth of the user. At this time, the aerosol is generated by as the outside air passes through the first portion, and the generated aerosol passes through the second portion and is delivered to a user's mouth.

For example, the outside air may be introduced through at least one air passage formed in the aerosol generator 1. For example, the opening and closing of the air passage formed in the aerosol generator 1 and/or the size of the air passage may be adjusted by a user. Accordingly, the amount and quality of the aerosol may be adjusted by the user. In another example, the outside air may be introduced into the cigarette 2 through at least one hole formed in a surface of the cigarette 2.

Hereinafter, an example of the cigarette 2 will be described with reference to FIGS. 4 and 5.

Figure 4:
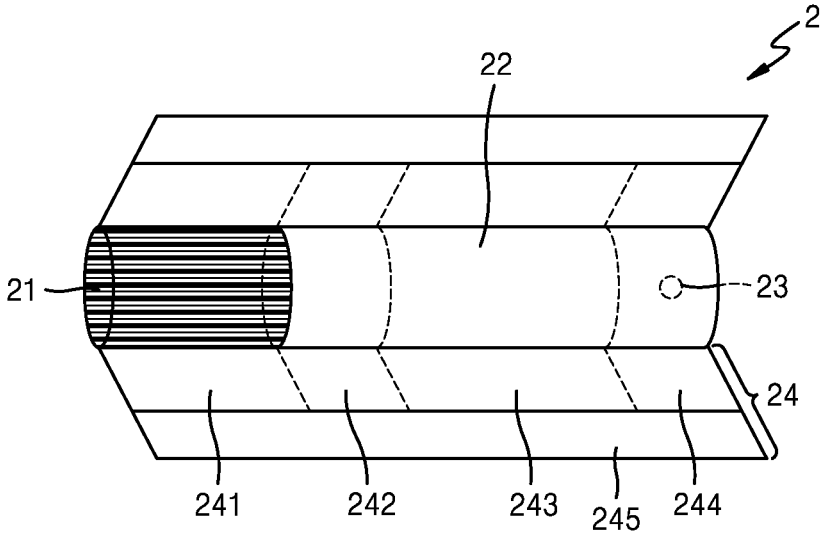
FIGS. 4 and 5 are diagrams showing examples of a cigarette.
Figure 5:
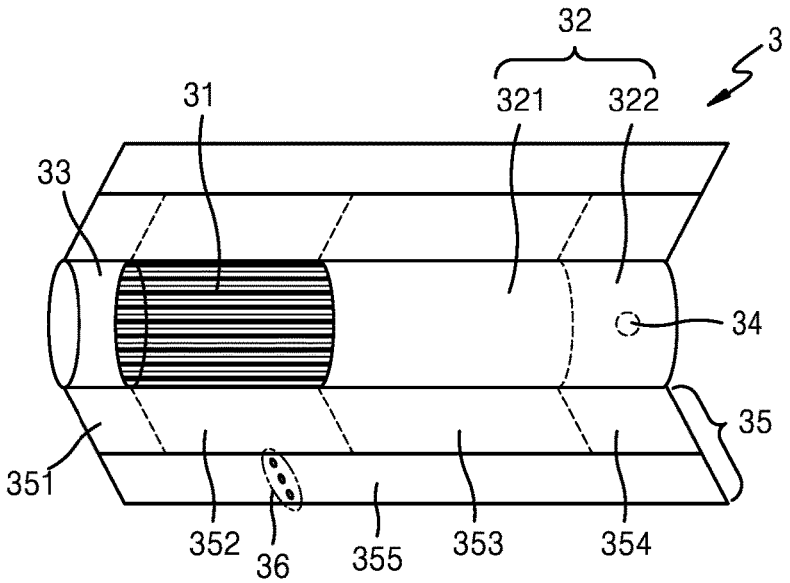

FIGS. 4 and 5 illustrate an example of a cigarette.

Referring to FIG. 4, the cigarette 2 includes a tobacco rod 21 and a filter rod 22. The first portion described above with reference to FIGS. 1 to 3 include the tobacco rod 21 and the second portion includes the filter rod 22.

In FIG. 4, the filter rod 22 is shown as a single segment, but is not limited thereto. In other words, the filter rod 22 may include a plurality of segments. For example, the filter rod 22 may include a first segment for cooling down the aerosol and a second segment for filtering a predetermined component included in the aerosol. Also, if necessary, the filter rod 22 may further include at least one segment performing another function.

The cigarette 2 may be packaged by at least one wrapper 24. The wrapper 24 may include at least one hole through which the outside air is introduced or inside air is discharged. For example, the cigarette 2 may be packaged by one wrapper 24. In another example, the cigarette 2 may be packaged by two or more wrappers 24. For example, the tobacco rod 21 may be packaged via a first wrapper 241, and the filter rod 22 may be packaged by wrappers 242 to 244. And the entire cigarette 2 may be packaged by another wrapper 245. When the filter rod 22 includes a plurality of segments, each segment may be packaged by separate wrappers 242, 243, and 244.

The tobacco rod 21 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. In addition, the tobacco rod 21 may include other additive materials like a flavoring agent, a wetting agent, and/or an organic acid. Also, a flavoring liquid such as menthol, humectant, etc. may be added to the tobacco rod 21 by being sprayed to the tobacco rod 21.

The tobacco rod 21 may be manufactured variously. For example, the tobacco rod 21 may be fabricated as a sheet or strands. Also, the tobacco rod 21 may be fabricated by tobacco leaves that are obtained by fine-cutting a tobacco sheet. Also, the tobacco rod 21 may be surrounded by a heat conducting material. For example, the heat-conducting material may be, but is not limited to, a metal foil such as aluminum foil. For example, the heat conducting material surrounding the tobacco rod 21 may improve a thermal conductivity applied to the tobacco rod by evenly dispersing the heat transferred to the tobacco rod 21, and thereby improving tobacco taste. Also, the heat conducting material surrounding the tobacco rod 21 may function as a susceptor that is heated by an inducting heating type heater. Although not shown in the drawings, the tobacco rod 21 may further include a susceptor, in addition to the heat conducting material surrounding the outside thereof.

The filter rod 22 may be a cellulose acetate filter. In addition, the filter rod 22 is not limited to a particular shape. For example, the filter rod 22 may be a cylinder type rod or a tube type rod including a cavity therein. Also, the filter rod 22 may be a recess type rod. When the filter rod 22 includes a plurality of segments, at least one of the plurality of segments may have a different shape from the others.

Also, the filter rod 22 may include at least one capsule 23. Here, the capsule 23 may generate flavor or may generate aerosol. For example, the capsule 23 may have a structure, in which a liquid containing a flavoring material is wrapped with a film. The capsule 23 may have a circular or cylindrical shape, but is not limited thereto.

Referring to FIG. 5, the cigarette 3 additionally includes a front-end plug 33. The front-end plug 33 may be located on a side of the tobacco rod 31 which does not face the filter rod 32. The front-end plug 33 may prevent the tobacco rod 31 from escaping to the outside and may prevent a liquefied aerosol from flowing from the tobacco rod 31 into an aerosol generating device (1 of FIGS. 1 to 3) during smoking.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

The diameter and the total length of the cigarette 3 may correspond to the diameter and the total length of the cigarette 2 of FIG. 4. For example, the length of the front end plug 33 is about 7 mm, the length of the cigarette rod 31 is about 15 mm, the length of the first segment 321 is about 12 mm, and the length of the second segment 322 is about 14 mm. However, embodiments are not limited thereto.

The cigarette 3 may be wrapped by at least one wrapper 35. At least one hole through which outside air flows in or inside gas flows out may be formed in the wrapper 35. For example, the front-end plug 33 may be wrapped by a first wrapper 241 351, the tobacco rod 31 may be wrapped by a second wrapper 352, the first segment 321 may be wrapped by a third wrapper 353, and the second segment 322 may be wrapped by a fourth wrapper 354. Also, the entire cigarette 3 may be re-wrapped by a fifth wrapper 355.

Also, at least one perforation 36 may be formed in the fifth wrapper 355. For example, the perforation 36 may be formed in a region surrounding the tobacco rod 31, but is not limited thereto. The perforation 36 may serve to transfer heat generated by the heater 13 shown in FIGS. 2 and 3 into the tobacco rod 31.

Also, the second segment 322 may include at least one capsule 34. Here, the capsule 34 may serve to generate a flavor or serve to generate an aerosol. For example, the capsule 34 may have a structure in which a liquid containing perfume is wrapped in a film. The capsule 34 may have a spherical or cylindrical shape, but is not limited thereto.

Figure 6:
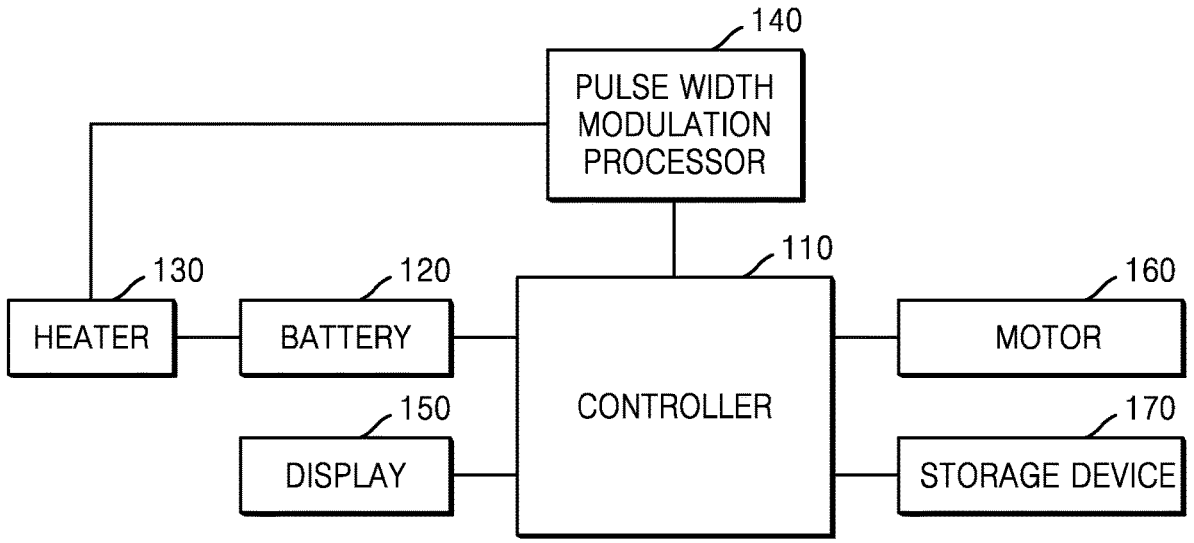
FIG. 6 is a diagram schematically showing an example of an aerosol generating apparatus according to the present disclosure.

FIG. 6 is a block diagram schematically showing an example of an aerosol generating apparatus according to the present disclosure.

Referring to FIG. 6, an aerosol generating apparatus according to the present disclosure may include a controller 110, a battery 120, a heater 130, a pulse width modulation processor 140, a display 150, a motor 160, and a storage device 170. Hereinafter, the controller 110, the battery 120, the heater 130, and a vaporizer of FIG. 6 have the same structure as the controller 12, the battery 11, the heater 13, and the vaporizer 14 described with reference to FIGS. 2 and 3, respectively.

The controller 110 controls overall operations of the battery 120, the heater 130, the pulse width modulation processor 140, the display 150, the motor 160, and the storage device 170 included in the aerosol generating apparatus. Although not shown in FIG. 6, according to an embodiment, the controller 110 may further include an input reception unit (not shown) that receives a button input or a touch input of a user, and a communication unit (not shown) capable of communicating with an external communication device such as a user terminal. Although not shown in FIG. 6, the controller 110 may further include a module for performing a proportional integral differential control (PID) for the heater 130.

The battery 120 may supply electric power to the heater 130, and a level of the electric power supplied to the heater 130 may be adjusted by the controller 110.

The heater 130 generates heat by specific resistance thereof when a current is applied thereto, and when an aerosol generating material comes into contact with (couples to) the heated heater, an aerosol may be generated.

The pulse width modulation processor 140 causes the controller 110 to control the electric power supplied to the heater 130 by using a method of transmitting a pulse width modulation (PWM) signal to the heater 130. According to an embodiment, the pulse width modulation processor 140 may be included in the controller 110.

The display 150 visually outputs various alarm messages generated by the aerosol generating apparatus to a user of the aerosol generating apparatus. A user may check a battery power shortage message or a heater overheat warning message output to the display 150 and take appropriate measures before an operation of the aerosol generating apparatus is stopped or the aerosol generating apparatus is damaged.

The motor 160 may be driven by the controller 110 so that a user may recognize that the aerosol generating apparatus is ready for use through a tactile sense.

The storage device 170 stores various types of information for the controller 110 to properly control the electric power supplied to the heater 130 to provide various savors to a user by using the aerosol generating apparatus. For example, the storage device 170 pre-stores a temperature profile that is referred to by the controller 110 to appropriately adjust a temperature of the heater 130 over time, and may transmit the information to the controller 110 when requested by the controller 110. The storage device 170 may include not only a non-volatile memory such as a flash memory but also a volatile memory that temporarily stores data only during operation in order to secure a faster data input/output (I/O) speed.

The controller 110, the pulse width modulation processor 140, the display 150, the storage device 170, and the vaporizer according to an embodiment of the present disclosure correspond to at least one processor or may include at least one processor. Accordingly, the controller 110, the pulse width modulation processor 140, the display 150, the storage device 170, and the vaporizer may be driven in a form being included in another hardware device such as a microprocessor or a general-purpose computer system.

The aerosol generating apparatus according to the present disclosure includes the heater 130 for heating an aerosol generating material to generate an aerosol, and the controller 110 that controls electric power supplied to the heater 130. When a frequency of the electric power signal supplied to the heater 130 is less than or equal to a preset frequency, the controller 110 controls the frequency of the electric power signal to be changed over time within a certain range.

A specific method of controlling the electric power supplied to the heater 130 by the controller 110 according to the present disclosure will be described later with reference to FIGS. 7 to 10 below.

Figure 7:
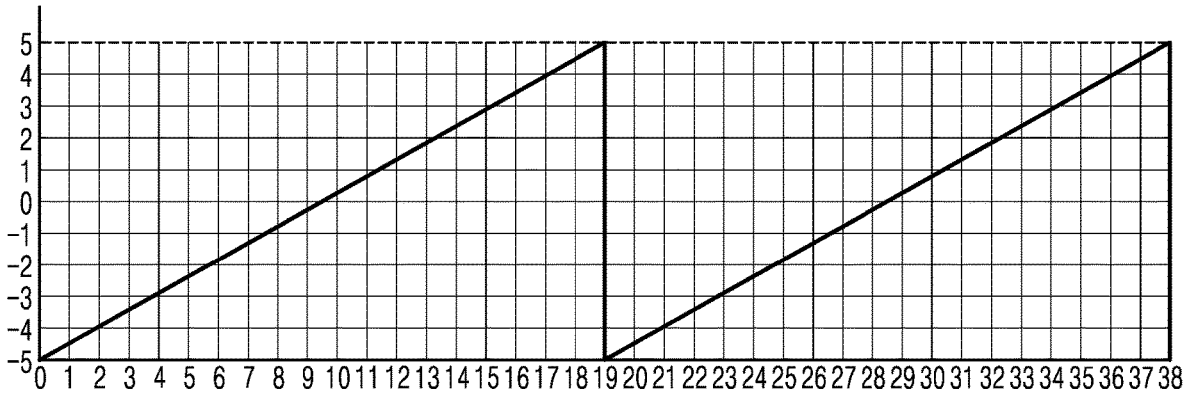
FIG. 7 is a graph showing an example of a frequency of an electric power signal supplied to a heater of an aerosol generating apparatus according to the present disclosure.

FIG. 7 is a graph showing an example of a frequency of an electric power signal supplied to a heater of an aerosol generating apparatus according to the present disclosure.

In FIG. 7, a horizontal axis represents time, and a vertical axis represents a frequency percentage (hereinafter, referred to as an "addition frequency rate") by which the controller 110 adjusts a reference frequency of the electric power signal. A unit of time on the horizontal axis in FIG. 7 is a second, but may be a millisecond or a microsecond according to an embodiment. The absolute value of the addition frequency rate in FIG. 7 depends on the reference frequency. The addition frequency rate is shown as a percentage value in FIG. 7.

According to the present disclosure, the controller 110 determines whether the frequency of the electric power signal supplied to the heater 130 is less than or equal to a preset frequency. If the determined frequency is less than or equal to the preset frequency, the controller 100 controls the frequency of the electric power signal supplied to the heater 130 to be changed over time within a certain range. Here, the certain range may be −5% to +5% as represented in the vertical axis of FIG. 7, but may be −10% to +10%, or −5% to +10% according to the embodiment.

In addition, in order for the controller 110 to control the frequency of the electric power signal to be changed over time in the certain range, it is required that the frequency of the electric power signal is less than or equal to a preset frequency. For example, the preset frequency may be 20 KHz.

Referring to FIG. 7, it may be seen that the controller 110 controls an addition frequency rate of the electric power signal to be changed for each unit of time. For example, according to FIG. 7, when a reference frequency of the electric power signal is determined to be 10 KHz which is less than or equal to the preset frequency, the controller 110 may determine 9.5 KHz calculated by adding −5% to the reference frequency of the electric power signal as the frequency of the electric power signal for supplying electric power to the heater 130. As another example, according to FIG. 7, the controller 110 may determine 10.5 KHz calculated by adding +5% to the reference frequency of the electric power signal as the frequency of the electric power signal of the heater 130 at a point in time when 19 seconds elapses after confirming that the reference frequency of the electric power signal is 10 KHz which is less than or equal to a preset frequency.

As shown in FIG. 7, a range of the addition frequency rate of the electric power signal controlled by the controller 110 is limited to a certain range. In addition, the controller 110 changes the addition frequency rate for each unit of time. According to FIG. 7, it may be seen that the frequency of the electric power signal transmitted to the heater 130 periodically reaches the lowest frequency or the highest frequency every 19 seconds. In FIG. 7, the controller 110 resets the addition frequency rate of the electric power signal every 19 seconds. According to the embodiment, a cycle in which the addition frequency rate is initialized may be a value other than 19 seconds.

Figure 8:
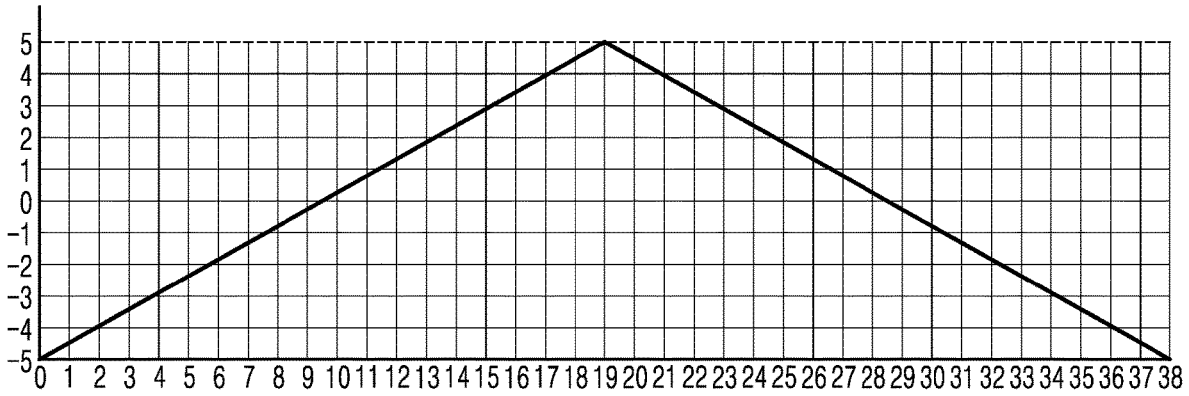
FIG. 8 is a graph showing another example of a frequency of an electric power signal supplied to a heater of an aerosol generating apparatus according to the present disclosure.

FIG. 8 is a graph showing another example of the frequency of the electric power signal supplied to the heater of the aerosol generating apparatus according to the present disclosure.

For the sake of convenient description, FIG. 8 will be described with reference to FIG. 7.

According to the optional embodiment shown in FIG. 8, the controller 110 determines whether the frequency of the electric power signal supplied to the heater 130 is less than or equal to a preset frequency, and when the determined frequency is less than or equal to the preset frequency, the controller 110 controls the frequency of the electric power signal to reach the lowest frequency and the highest frequency every fixed cycle. Here, a certain range may be −5% to +5% as represented in the vertical axis of FIG. 8, but may be −10% to +10%, or −5% to +10% according to the embodiment.

When comparing FIG. 8 with FIG. 7, it may be seen that a cycle of the graph of the addition frequency rate is 38 seconds instead of 19 seconds as in FIG. 7. More specifically, when the addition frequency rate reaches a maximum value of 5% after 19 seconds elapse, the controller 110 controls the addition frequency rate to be sequentially reduced to −5% over time without initializing the addition frequency rate.

As an example, when the reference frequency of the electric power signal of the heater is determined to be 10 KHz and the addition frequency rate at a point in time when 15 seconds or 23 seconds elapse is +3% after the electric power signal is transmitted to the heater 130, the controller 110 may determine both the frequency at a point in time when 15 seconds elapse and the frequency at a point in time when 23 seconds elapse after the electric power signal is transmitted to the heater 130 as 10.3 KHz. In FIG. 8, the controller 110 may reset the addition frequency rate every 38 seconds. According to the embodiment, the cycle for initializing the addition frequency rate may be a value other than 38 seconds.

The embodiment according to FIG. 8 is similar to the embodiment according to FIG. 7 in that the controller 110 controls the frequency of the electric power signal to reach the lowest frequency and the highest frequency periodically, but is different from the embodiment according to FIG. 7 in that the cycle of the graph of the addition frequency rate is two times the cycle of the graph according to the embodiment shown in FIG. 7 because the addition frequency rate is not initialized after the frequency of the electric power signal of the heater 130 is increased to the highest frequency.

Figure 9:
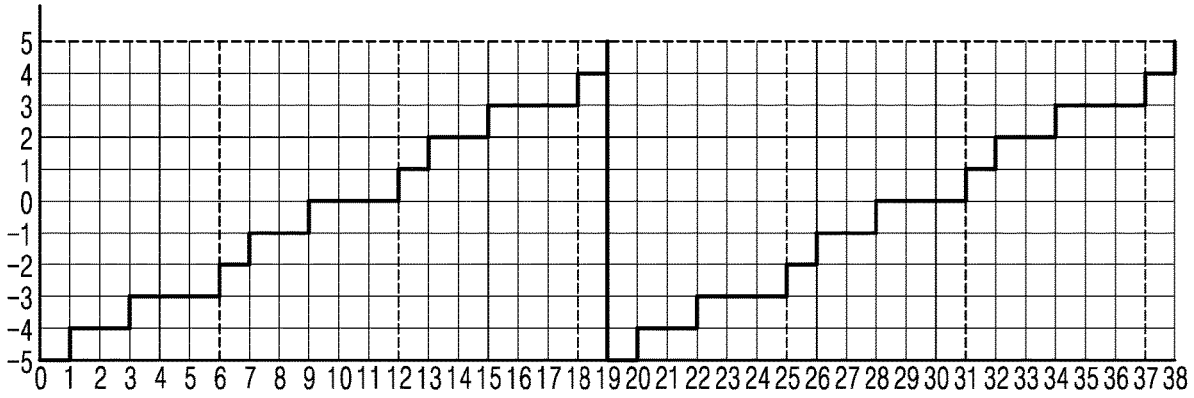
FIG. 9 is a graph showing another example of a frequency of an electric power signal supplied to a heater of an aerosol generating apparatus according to the present disclosure.

FIG. 9 is a graph showing another example of the frequency of the electric power signal supplied to the heater of the aerosol generating apparatus according to the present disclosure.

For the sake of convenient description, FIG. 9 will be described with reference to FIG. 7.

In FIG. 9, the controller 110 controls the unit of time for changing the addition frequency rate to vary. When comparing FIG. 9 with FIG. 7, it may be seen that the controller 110 changes the addition frequency rate for each unit of time in FIG. 7, wherein the controller 110 controls the unit of time for changing the addition frequency rate to be increased or decreased according to a preset pattern in FIG. 9.

For example, in FIG. 9, the addition frequency rate is changed to −5%, −4%, −4%, −3%, −3%, −3% over time, and the unit of time for changing the addition frequency rate is changed in the order of 1 second, 2 seconds, and 3 seconds. Here, the order or 1 second, 2 seconds, and 3 seconds constitutes a time pattern.

Subsequently, the addition frequency rate may be changed in the order of −2%, −1%, −1%, 0%, 0%, 0%, and the controller 110 may calculate the frequency of the electric power signal of the heater 130 with reference to the addition frequency rate according to FIG. 9. In FIG. 9, after reaching 5% which is a limit value of a certain range previously set, the addition frequency rate is initialized to −5% as shown in FIG. 7.

Figure 10:
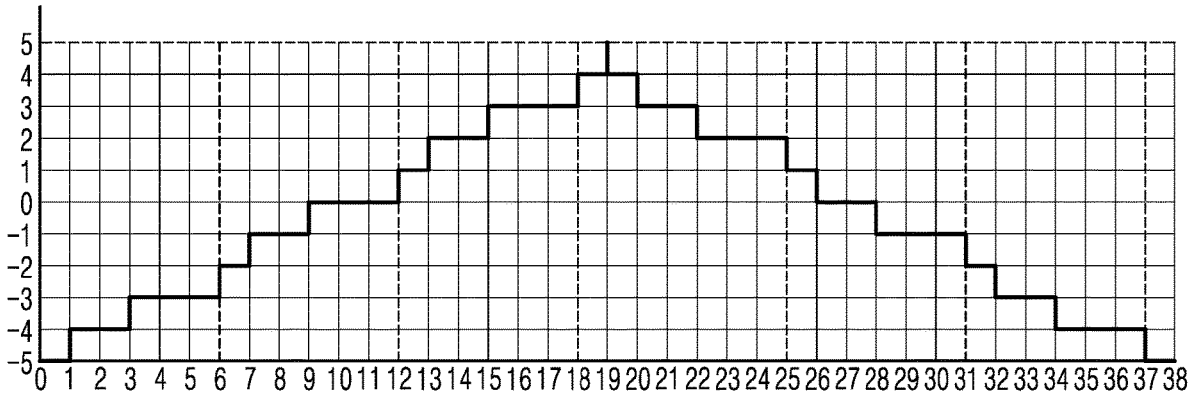
FIG. 10 is a graph showing another example different from the above-described example and showing a frequency of an electric power signal supplied to a heater of an aerosol generating apparatus according to the present disclosure.

FIG. 10 is a graph showing another example different from the above-described example and showing a frequency of an electric power signal supplied to a heater of an aerosol generating apparatus according to the present disclosure.

For the sake of convenient description, FIG. 10 will be described with reference to FIG. 8.

In FIG. 10, the controller 110 controls a unit of time for changing the addition frequency rate to vary. When comparing FIG. 10 with FIG. 8, it may be seen that the controller 110 controls the addition frequency rate for each unit of time in FIG. 8, whereas the controller 110 controls the unit of time for changing the addition frequency rate to be increased or decreased according to a preset pattern in FIG. 10.

For example, in FIG. 10, the addition frequency rate is changed to −5%, −4%, −4%, −3%, −3%, −3%, and the unit of time in which the addition frequency rate is changed is in the order of 1 second, 2 seconds, and 3 seconds. Here, the order of 1 second, 2 seconds, and 3 seconds, in which the addition frequency rate is changed, constitutes a time pattern. Subsequently, the addition frequency rate is changed in the order of −2%, −1%, −1%, 0%, 0%, 0%, and the controller 110 may calculate the frequency of the electric power signal of the hearer 130 with reference to the addition frequency rate according to FIG. 10. In FIG. 10, after reaching 5% which is a limit value of a certain range previously set, the addition frequency rate is sequentially decreased to −5% according to a preset time pattern.

According to the embodiments shown in FIGS. 7 to 10, when it is determined that the frequency of the electric power signal for supplying electric power to the heater 130 is less than or equal to a preset frequency, the controller 110 of the aerosol generating apparatus according to the present disclosure may increase or decrease a frequency of electric power within a certain range over time, thereby, preventing resonance noise of the aerosol generating apparatus which may be generated due to a low frequency signal. In addition, when a pulse width modulation (PWM) signal is used as an electric power signal, electric power loss due to rising and falling of a square wave may be minimized and tendency to be affected by an external noise signal may be greatly reduced.

Figure 11:
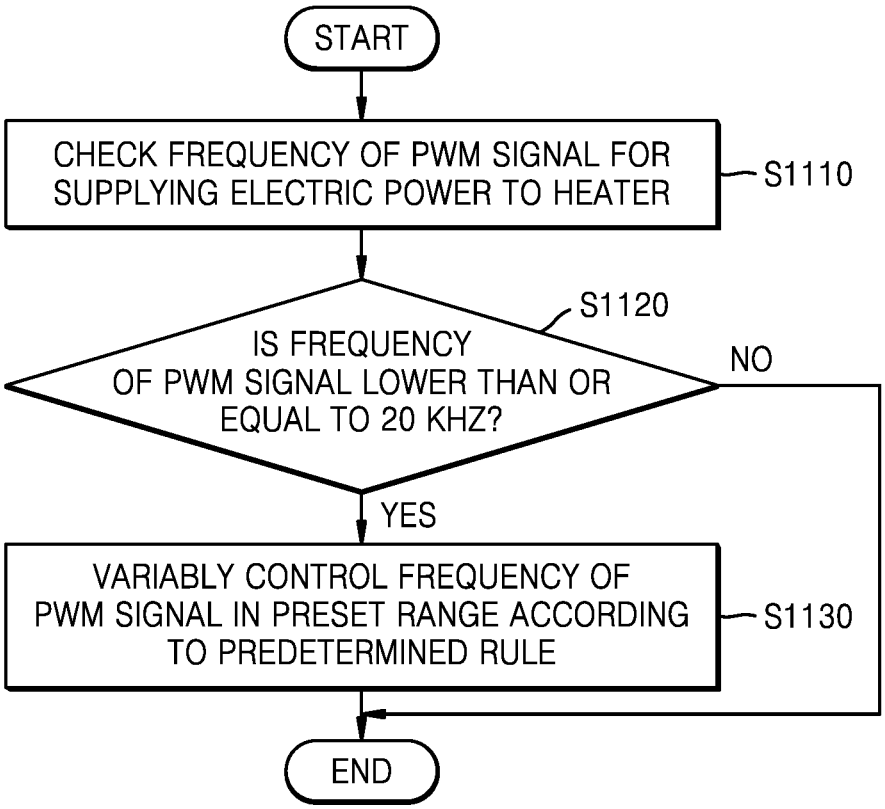
FIG. 11 is a flowchart showing an example of a method of controlling electric power supplied to a heater of an aerosol generating apparatus according to the present disclosure.

FIG. 11 is a flowchart showing an example of a method of controlling electric power supplied to a heater of an aerosol generating apparatus according to the present disclosure.

FIG. 11 may be implemented by the aerosol generating apparatus according to FIG. 6 and will be described with reference to FIG. 6, and descriptions overlapping the description made with reference to FIGS. 6 to 10 will be omitted below.

First, the controller 110 checks a frequency of a PWM signal that supplies electric power to the heater 130 (S1110).

When the frequency of the PWM signal for supplying electric power to the heater 130 is 20 KHz or less (S1120), the controller 110 controls the frequency of the PWM signal to be changed according to a certain rule within a preset range (S1130).

In step S1130, the frequency of the PWM signal may be changed according to an addition frequency rate. As described above with reference to FIGS. 7 to 10, the addition frequency rate for each point in time may be determined through a method of changing the addition frequency rate uniformly in each unit of time or a method of changing a pattern of a unit of time for changing the addition frequency.

The embodiments according to the present disclosure described above may be implemented in the form of a computer program that may be executed by various configuration elements in a computer, and the computer program may be recorded on a computer-readable medium. At this time, the medium may include a magnetic medium such as hard disk, floppy disk, or magnetic tape, an optical recording medium such as CD-ROM or DVD, a magneto-optical medium such as floptical disk, and a hardware device, which is particularly configured to store and execute program instructions, such as ROM, RAM, or flash memory.

Meanwhile, the computer program may be designed in particular and configured for the present disclosure or may be known and available to those skilled in a computer software field. Examples of a computer program may include not only machine language codes generated by a compiler, but also high-level language codes executable by a computer by using an interpreter or the like.

The specific implementations described in the present disclosure are example embodiments and do not limit the scope of the present disclosure in any way. For the sake of brief specification, descriptions on electronic configurations, control systems, and software of the related art, and other functional aspects of the systems may be omitted. In addition, the connections or connection elements of the lines between the configuration elements shown in the drawings are illustrative examples of functional connections and/or physical or circuit connections, which may be replaced or may be represented as additional various functional connections, physical connections, or circuit connections in actual devices. In addition, unless there is specific description such as "essential" and "importantly", it may not be a necessary configuration element for application of the present disclosure.

In the specification (particularly in the claims) of the present disclosure, use of the term "above" and similar indication term may be in both singular and plural. In addition, in a case of describing a range in the present disclosure, the range includes an invention to which individual values belonging to the range are applied (if there is no contrary description) and is the same as each individual value constituting the range is described in the detailed description of the disclosure. Finally, unless there is an explicit or contradictory description of the steps constituting the method according to the disclosure, the steps may be performed in a suitable order. The present disclosure is not necessarily limited to the description order of the above steps. Use of all examples or exemplary terms (for example, etc.) in the present disclosure is merely for describing the present disclosure in detail, and the scope of the present disclosure is limited due to the examples or exemplary terms, unless defined by the claims. In addition, those skilled in the art may recognize that various modifications, combinations, and changes may be configured according to design conditions and factors within the scope of the appended claims or equivalents thereof.

INDUSTRIAL APPLICABILITY

One embodiment of the present disclosure may be used to manufacture next-generation electronic cigarettes with improved performance than the related art.

What is claimed is:

1. An aerosol generating apparatus comprising:

a heater configured to generate an aerosol by heating an aerosol generating material; and a controller configured to:

determine whether or not a frequency of an electric power signal supplied to the heater is lower than or equal to a preset frequency, wherein the preset frequency is 20 kHz, which is a maximum value of audible frequency range;

control electric power supplied to the heater to be changed over time within a preset range only when the frequency of an electric power signal is lower than or equal to the preset frequency;

control a unit of time for changing the frequency of the electric power signal to be increased or decreased according to a preset time pattern in which the unit of time for changing the frequency is on an order of one second, two seconds, and three seconds, over a time period of six seconds; and based on the frequency being increased from a predetermined lower limit to a predetermined upper limit using the preset time pattern, control the frequency to be decreased to the predetermined lower limit using a same time pattern as the preset time pattern.

2. The aerosol generating apparatus of claim 1, wherein the electric power signal is a pulse width modulation signal.

3. The aerosol generating apparatus of claim 1, wherein the preset range is −10% to +10% of the frequency of the electric power signal.

4. The aerosol generating apparatus of claim 1, wherein the preset range is −5% to +5% of the frequency of the electric power signal.

5. The aerosol generating apparatus of claim 1, wherein the controller is further configured to control the frequency of the electric power signal to reach a lowest frequency and a highest frequency periodically according to a fixed cycle.

6. A method of controlling electric power supplied to a heater of an aerosol generating apparatus with a signal having a frequency less than or equal to a preset frequency, the method comprising:

determining whether or not a frequency of an electric power signal supplied to the heater is lower than or equal to a preset frequency, wherein the preset frequency is 20 kHz, which is a maximum value of audible frequency range;

controlling the frequency of the electric power signal to be changed over time within a preset range only when the frequency of an electric power signal is lower than or equal to the preset frequency;

controlling a unit of time for changing the frequency of the electric power signal to be increased or decreased according to a preset time pattern in which the unit of time for changing the frequency is on an order of one second, two seconds, and three seconds, over a time period of six seconds; and based on the frequency being increased to from a predetermined lower limit to a predetermined upper limit using the preset time pattern, controlling the frequency to be decreased to the predetermined lower limit using a same time pattern as the preset time pattern.

7. The method of controlling the electric power supplied to the heater of the aerosol generating apparatus of claim 6, wherein the electric power signal is a pulse width modulation signal.

8. The method of controlling the electric power supplied to the heater of the aerosol generating apparatus of claim 6, wherein the preset range is −10% to +10% of the frequency of the electric power signal.

9. The method of controlling the electric power supplied to the heater of the aerosol generating apparatus of claim 6, wherein the preset range is −5% to +5% of the frequency of the electric power signal.

10. The method of controlling the electric power supplied to the heater of the aerosol generating apparatus of claim 6, wherein the controlling comprises controlling the frequency of the electric power signal to reach a lowest frequency and a highest frequency periodically according to a fixed cycle.

11. A non-transitory computer-readable recording medium having stored thereon a program for executing the method according to claim 6.

* * * * *